US008751246B2

(12) United States Patent
Lecomte et al.

(10) Patent No.: US 8,751,246 B2
(45) Date of Patent: Jun. 10, 2014

(54) AUDIO ENCODER AND DECODER FOR ENCODING FRAMES OF SAMPLED AUDIO SIGNALS

(75) Inventors: Jeremie Lecomte, Fuerth (DE); Philippe Gournay, Sherbrooke (CA); Stefan Bayer, Nuremberg (DE); Markus Multrus, Nuremberg (DE); Nikolaus Rettelbach, Nuremberg (DE)

(73) Assignees: Fraunhofer-Gesellschaft zur Foerderung der Angewandten Forschung E.V., Munich (DE); Voiceage Corporation, Montreal, Quebec (CA)

( * ) Notice: Subject to any disclaimer, the term of this patent is extended or adjusted under 35 U.S.C. 154(b) by 560 days.

(21) Appl. No.: 13/004,335

(22) Filed: Jan. 11, 2011

(65) Prior Publication Data

US 2011/0173008 A1 Jul. 14, 2011

Related U.S. Application Data

(63) Continuation of application No. PCT/EP2009/004947, filed on Jul. 8, 2009.

(60) Provisional application No. 61/079,851, filed on Jul. 11, 2008, provisional application No. 61/103,825, filed on Oct. 8, 2008.

(51) Int. Cl.

| | |
|---|---|
| ***G10L 19/00*** | (2013.01) |
| ***G10L 19/02*** | (2013.01) |
| ***G10L 19/04*** | (2013.01) |

(52) U.S. Cl.

USPC ..... 704/501; 704/205; 704/219

(58) Field of Classification Search

CPC ..... G10L 19/00; G10L 19/02; G10L 19/04; G10L 19/087; G10L 19/18; G10L 19/20; G10L 19/22

USPC ..... 704/203, 205, 206, 219, 220, 500, 501

See application file for complete search history.

(56) References Cited

U.S. PATENT DOCUMENTS 5,533,052 A * 7/1996 Bhaskar ..... 375/244
5,579,430 A 11/1996 Grill et al.

(Continued)

FOREIGN PATENT DOCUMENTS

EP 1396844 3/2004
EP 2302623 3/2011

(Continued)

OTHER PUBLICATIONS

John P. Princen; Analysis/Synthesis Filter Bank Design Based on Time Domain Aliasing Cancellation; 9 pages; IEEE Transactions on Acoustics Speech, and Signal Processing, Vo. ASSP-34, No. 5, Oct. 1986.

(Continued)

*Primary Examiner* — Martin Lerner

(74) *Attorney, Agent, or Firm* — Perkins Coie LLP; Michael A. Glenn

(57) ABSTRACT

An audio encoder adapted for encoding frames of a sampled audio signal to obtain encoded frames, wherein a frame has a number of time domain audio samples, having a predictive coding analysis stage for determining information on coefficients of a synthesis filter and information on a prediction domain frame based on a frame of audio samples. The audio encoder further has a frequency domain transformer for transforming a frame of audio samples to the frequency domain to obtain a frame spectrum and an encoding domain decider for deciding whether encoded data for a frame is based on the information on the coefficients and on the information on the prediction domain frame, or based on the frame spectrum. Moreover, the audio encoder has a controller for determining an information on a switching coefficient when the encoding domain decider decides that encoded data of a current frame is based on the information on the coefficients and the information on the prediction domain frame when encoded data of a previous frame was encoded based on a previous frame spectrum and a redundancy reducing encoder for encoding the information on the prediction domain frame, the information on the coefficients, the information on the switching coefficient and/or the frame spectrum.

15 Claims, 16 Drawing Sheets

(56) References Cited

U.S. PATENT DOCUMENTS

| | | | | |
|---|---|---|---|---|
| 5,974,374 | A | 10/1999 | Wake | |
| 6,233,550 | B1 * | 5/2001 | Gersho et al. | 704/208 |
| 6,658,383 | B2 * | 12/2003 | Koishida et al. | 704/229 |
| 7,325,023 | B2 | 1/2008 | Youn | |
| 7,876,966 | B2 * | 1/2011 | Ojanpera | 382/232 |
| 7,933,769 | B2 * | 4/2011 | Bessette | 704/219 |
| 7,979,271 | B2 * | 7/2011 | Bessette | 704/219 |
| 8,447,620 | B2 * | 5/2013 | Neuendorf et al. | 704/500 |
| 8,484,038 | B2 * | 7/2013 | Bessette et al. | 704/500 |
| 8,595,019 | B2 * | 11/2013 | Geiger et al. | 704/501 |
| 8,630,862 | B2 * | 1/2014 | Geiger et al. | 704/500 |
| 2003/0009325 | A1 * | 1/2003 | Kirchherr et al. | 704/211 |
| 2004/0044534 | A1 | 3/2004 | Chen et al. | |
| 2007/0112559 | A1 | 5/2007 | Schuijers et al. | |
| 2007/0147518 | A1 * | 6/2007 | Bessette | 375/243 |
| 2008/0004869 | A1 * | 1/2008 | Herre et al. | 704/211 |
| 2010/0138218 | A1 * | 6/2010 | Geiger | 704/205 |
| 2011/0173011 | A1 * | 7/2011 | Geiger et al. | 704/500 |
| 2011/0202355 | A1 * | 8/2011 | Grill et al. | 704/500 |
| 2011/0238425 | A1 * | 9/2011 | Neuendorf et al. | 704/500 |
| 2012/0253797 | A1 * | 10/2012 | Geiger et al. | 704/219 |
| 2012/0271644 | A1 * | 10/2012 | Bessette et al. | 704/500 |
| 2013/0066640 | A1 * | 3/2013 | Grill et al. | 704/500 |
| 2013/0332153 | A1 * | 12/2013 | Markovic et al. | 704/219 |

FOREIGN PATENT DOCUMENTS

| | | |
|---|---|---|
| RU | 2141166 | 4/1990 |
| RU | 2005135650 | 3/2006 |
| WO | WO 03/090209 A1 | 10/2003 |
| WO | WO-2004082288 | 9/2004 |
| WO | WO 2008/071353 A1 | 6/2008 |

OTHER PUBLICATIONS

3GPP TS 26.290 v9.0.0 (Sep. 2009); 3rd Generation Partneship Project; Technical Specification Group Service and System Aspects; Audio Codec Processing Functions; Extended Adaptive Multi-Rate—Wideband (AMR-WB+) Codec; Transcoding Functions (Release 9).

PCT/EP2009/004947 International Search Report and Written Opinion; 16 pages; date of mailing Dec. 10, 2009.

* cited by examiner folding: $(-c_R - d, a - b_R)$ R: reverse operator (2N input val.

⇩

N output val.)

unfolding: $(a - b_R, b - a_R, c + d_R, d + c_R) \cdot 1/2$ ( N input val.

⇩

2N output val.) $\text{MDCT}\underbrace{(a, b, c, d)}_{\text{2N output values}} \equiv \text{DCT-IV}\underbrace{(-c_R - d, a - b_R)}_{\text{N input values}}$ $$\underbrace{\text{IMDCT}(\text{MDCT}(a, b, c, d)}_{\text{2N output values}} = (a - b_R, b - a_R, c + d_R, d + c_R)\ 1/2$$

original signal original signal original signal

LPD Start-up

LPD Start-up

LPD Start-up

LPD Start-up

LPD Start-up

LPD Start-up

AUDIO ENCODER AND DECODER FOR ENCODING FRAMES OF SAMPLED AUDIO SIGNALS

CROSS-REFERENCE TO RELATED APPLICATIONS

This application is a continuation of copending International Application No. PCT/EP2009/004947, filed Jul. 8, 2009, which is incorporated herein by reference in its entirety, and additionally claims priority from U.S. Patent Application Nos. 61/079,851, filed Jul. 11, 2008 and U.S. Patent Application No. 61/103,825, filed Oct. 8, 2008, which are all incorporated herein by reference in their entirety.

BACKGROUND OF THE INVENTION

The present invention is in the field of audio encoding/decoding, especially of audio coding concepts utilizing multiple encoding domains.

In the art, frequency domain coding schemes such as MP3 or AAC are known. These frequency-domain encoders are based on a time-domain/frequency-domain conversion, a subsequent quantization stage, in which the quantization error is controlled using information from a psychoacoustic module, and an encoding stage, in which the quantized spectral coefficients and corresponding side information are entropy-encoded using code tables.

On the other hand there are encoders that are very well suited to speech processing such as the AMR-WB+ as described in 3GPP TS 26.290. Such speech coding schemes perform an LP (LP=Linear Predictive) filtering of a time-domain signal. Such an LP filtering is derived from a linear prediction analysis of the input time-domain signal. The resulting LP filter coefficients are then quantized/coded and transmitted as side information. The process is known as LPC (LPC=Linear Prediction Coding). At the output of the filter, the prediction residual signal or prediction error signal which is also known as the excitation signal is encoded using the analysis-by-synthesis stages of the ACELP encoder or, alternatively, is encoded using a transform encoder, which uses a Fourier transform with an overlap. The decision between the ACELP coding and the Transform Coded eXcitation coding, which is also called TCX, coding is done using a closed loop or an open loop algorithm.

Frequency-domain audio coding schemes such as the high efficiency-AAC encoding scheme, which combines an AAC coding scheme and a spectral band replication technique can also be combined with a joint stereo or a multi-channel coding tool which is known under the term "MPEG surround".

On the other hand, speech encoders such as the AMR-WB+ also have a high frequency enhancement stage and a stereo functionality.

Frequency-domain coding schemes are advantageous in that they show a high quality at low bitrates for music signals. Problematic, however, is the quality of speech signals at low bitrates. Speech coding schemes show a high quality for speech signals even at low bitrates, but show a poor quality for music signals at low bitrates.

Frequency-domain coding schemes often make use of the so-called MDCT (MDCT=Modified Discrete Cosine Transform). The MDCT has been initially described in J. Princen, A. Bradley, "Analysis/Synthesis Filter Bank Design Based on Time Domain Aliasing Cancellation", IEEE Trans. ASSP, ASSP-34(5):1153-1161, 1986. The MDCT or MDCT filter bank is widely used in modern and efficient audio coders. This kind of signal processing provides the following advantages:

Smooth cross-fade between processing blocks: Even if the signal in each processing block is altered differently (e.g. due to quantization of spectral coefficients), no blocking artifacts due to abrupt transitions from block to block occur because of the windowed overlap/add operation.

Critical sampling: The number of spectral values at the output of the filter bank is equal to the number of time domain input values at its input and additional overhead values have to be transmitted.

The MDCT filter bank provides a high frequency selectivity and coding gain.

Those great properties are achieved by utilizing the technique of time domain aliasing cancellation. The time domain aliasing cancellation is done at the synthesis by overlap-adding two adjacent windowed signals. If no quantization is applied between the analysis and the synthesis stages of the MDCT, a perfect reconstruction of the original signal is obtained. However, the MDCT is used for coding schemes, which are specifically adapted for music signals. Such frequency-domain coding schemes have, as stated before, reduced quality at low bit rates for speech signals, while specifically adapted speech coders have a higher quality at comparable bit rates or even have significantly lower bit rates for the same quality compared to frequency-domain coding schemes.

Speech coding techniques such as the AMR-WB+ (AMR-WB+=Adaptive Multi-Rate WideBand extended) codec as defined in "Extended Adaptive Multi-Rate-Wideband (AMR-WB+) codec", 3GPP TS 26.290 V6.3.0, 2005-06, Technical Specification, do not apply the MDCT and, therefore, can not take any advantage from the excellent properties of the MDCT which, specifically, rely in a critically sampled processing on the one hand and a crossover from one block to the other on the other hand. Therefore, the crossover from one block to the other obtained by the MDCT without any penalty with respect to bit rate and, therefore, the critical sampling property of MDCT has not yet been obtained in speech coders.

When one would combine speech coders and audio coders within a single hybrid coding scheme, there is still the problem of how to obtain a switch-over from one coding mode to the other coding mode at a low bit rate and a high quality.

Conventional audio coding concepts are usually designed to be started at the beginning of an audio file or of a communication. Using these conventional concepts, filter structures, as for example prediction filters, reach a steady state at a certain time the beginning of the encoding or decoding procedure. For a switched audio coding system, however, using for example transform based coding on the one hand, and speech coding according to a previous analysis of the input on the other hand, the respective filter structures are not actively and continuously updated. For example, speech coders can be solicited to be frequently restarted in a short period of time. Once restarted, a start up period starts over again, the internal states are reset to zero. The duration needed by, for example a speech coder to reach a steady state can be critical especially for the quality of the transitions.

Conventional concepts as for example the AMR-WB+, cf. "Extended Adaptive Multi-Rate-Wideband (AMR-WB+) codec", 3GPP TS 26.290 V6.3.0, 2005-06, Technical specification, use a total reset of the speech coder when transiting or switching between the transform based coder and the speech coder.

The AMR-WB+ is optimized under the condition that it starts only one time when the signal is faded in, supposing that there are no intermediate stops or resets. Hence, all the memories of the coder can be updated on a frame by frame basis. In case the AMR-WB+ is used in the middle of a signal, a reset has to be called, and all memories used on the encoding or decoding side are set to zero. Therefore, conventional concepts have the problem that too long durations are applied before reaching a steady state of the speech coder, along with the introduction of strong distortions in the non-steady phases.

Another disadvantage of conventional concepts is that they utilize long overlapping segments when switching coding domains introducing overheads, which disadvantageously effects coding efficiency.

SUMMARY

According to an embodiment, an audio encoder adapted for encoding frames of a sampled audio signal to acquire encoded frames, wherein a frame has a number of time domain audio samples, may have a predictive coding analysis stage for determining information on coefficients of a synthesis filter and information on a prediction domain frame based on a frame of audio samples; a frequency domain transformer for transforming a frame of audio samples to the frequency domain to acquire a frame spectrum; an encoding domain decider for deciding whether encoded data for a frame is based on the information on the coefficients and on the information on the prediction domain frame, or based on the frame spectrum; a controller for determining information on a switching coefficient when the encoding domain decider decides that encoded data of a current frame is based on the information on the coefficients and the information on the prediction domain frame when encoded data of a previous frame was encoded based on a previous frame spectrum acquired by the frequency domain transformer; and a redundancy reducing encoder for encoding the information on the prediction domain frame, the information on the coefficients, the information on the switching coefficient and/or the frame spectrum, wherein the information on the switching coefficient has an information enabling an initialization of a predictive synthesis stage, and the controller is adapted for determining the information on the switching coefficient based on an LPC analysis of the previous frame, and the controller is adapted for determining the information on the switching coefficient based on a high pass filtered version of a decoded frame spectrum of the previous frame.

According to another embodiment, a method for encoding frames of a sampled audio signal to acquire encoded frames, wherein a frame has a number of time domain audio samples may have the steps of determining information on coefficients of a synthesis filter and information on a prediction domain frame based on a frame of audio samples; transforming a frame of audio samples to the frequency domain to acquire a frame spectrum; deciding whether encoded data for a frame is based on the information on the coefficients and on the information on the prediction domain frame, or based on the frame spectrum; determining information on a switching coefficient when it is decided that encoded data of a current frame is based on the information on the coefficients and the information on the prediction domain frame when encoded data of a previous frame was encoded based on a previous frame spectrum acquired by the frequency domain transformer; and encoding the information on the prediction domain frame, the information on the coefficients, the information on the switching coefficient and/or the frame spectra, wherein the information on the switching coefficient has an information enabling an initialization of a predictive synthesis stage, and the determination of the information on the switching coefficient is performed based on an LPC analysis of the previous frame, and the controller is adapted for determining the information on the switching coefficient based on a high pass filtered version of a decoded frame spectrum of the previous frame.

According to another embodiment, an audio decoder for decoding encoded frames to acquire frames of a sampled audio signal, wherein a frame has a number of time domain audio samples may have a redundancy retrieving decoder for decoding the encoded frames to acquire information on a prediction domain frame, information on coefficients for a synthesis filter and/or a frame spectrum; a predictive synthesis stage for determining a predicted frame of audio samples based on the information on the coefficients for the synthesis filter and the information on the prediction domain frame; a time domain transformer for transforming the frame spectrum to the time domain to acquire a transformed frame from the frame spectrum; a combiner for combining the transformed frame and the predicted frame to acquire the frames of the sampled audio signal; and a controller for controlling a switch-over process, the switch-over process being effected when a previous frame is based on a transformed frame and a current frame is based on a predicted frame, the controller being configured for providing a switching coefficient to the predictive synthesis stage for initialization of the predictive synthesis stage based on an LPC analysis of the previous frame so that the predictive synthesis stage is initialized when the switch-over process is effected.

According to another embodiment, a method for decoding encoded frames to acquire frames of a sampled audio signal, wherein a frame has a number of time domain audio samples may have the steps of decoding the encoded frames to acquire information on a prediction domain frame, and information on coefficients for a synthesis filter and/or a frame spectrum; determining a predicted frame of audio samples based on the information of the coefficients for the synthesis filter and the information on the prediction domain frame; transforming the frame spectrum to the time domain to acquire a transformed frame from the frame spectrum; combining the transformed frame and the predicted frame to acquire the frames of the sampled audio signal; and controlling a switch-over process, the switch-over process being effected when a previous frame is based on the transformed frame, and a current frame is based on the predicted frame; providing a switching coefficient for initialization based on an LPC analysis of the previous frame so that a predictive synthesis stage is initialized when the switch-over process is effected.

According to another embodiment, a computer program may have a program code for performing, when a computer program runs on a computer or processor, one of the above mentioned methods.

The present invention is based on the finding that the above-mentioned problems can be solved in a decoder, by considering state information of an according filter after reset. For example, after reset, when the states of a certain filter have been set to zero, the start-up or warm up procedure of the filter can be shortened, if the filter is not started from scratch, i.e. with all states or memories set to zero, but fed with an information on a certain state, starting from which a shorter start-up or warm up period can be realized.

It is another finding of the present invention that said information on a switching state can be generated on the encoder or the decoder side. For example, when switching between a prediction based encoding concept and a transform based encoding concept, additional information can be provided before switching, in order to enable the decoder to take the prediction synthesis filters to a steady state before actually having to use its outputs.

In other words, it is the finding of the present invention that especially when switching between the transform domain to the prediction domain in a switched audio coder, additional information on filter states shortly before an actual switch-over to the prediction domain, can resolve the problem of generating switching artifacts.

It is another finding of the present invention that such information on the switch over can be generated at the decoder only, by considering its outputs shortly before the actual switch-over takes place, and basically run encoder processing on said output, in order to determine an information on filter or memory states shortly before the switching. Some embodiments can therewith use conventional encoders and reduce the problem of switching artifacts solely by decoder processing. Taking said information into account, for example, prediction filters can already be warmed up prior to the actual switch-over, e.g. by analyzing the output of a corresponding transform domain decoder.

BRIEF DESCRIPTION OF THE DRAWINGS

Embodiments of the present invention will be detailed using the accompanying figures, in which.

DETAILED DESCRIPTION OF THE INVENTION

Figure 1:
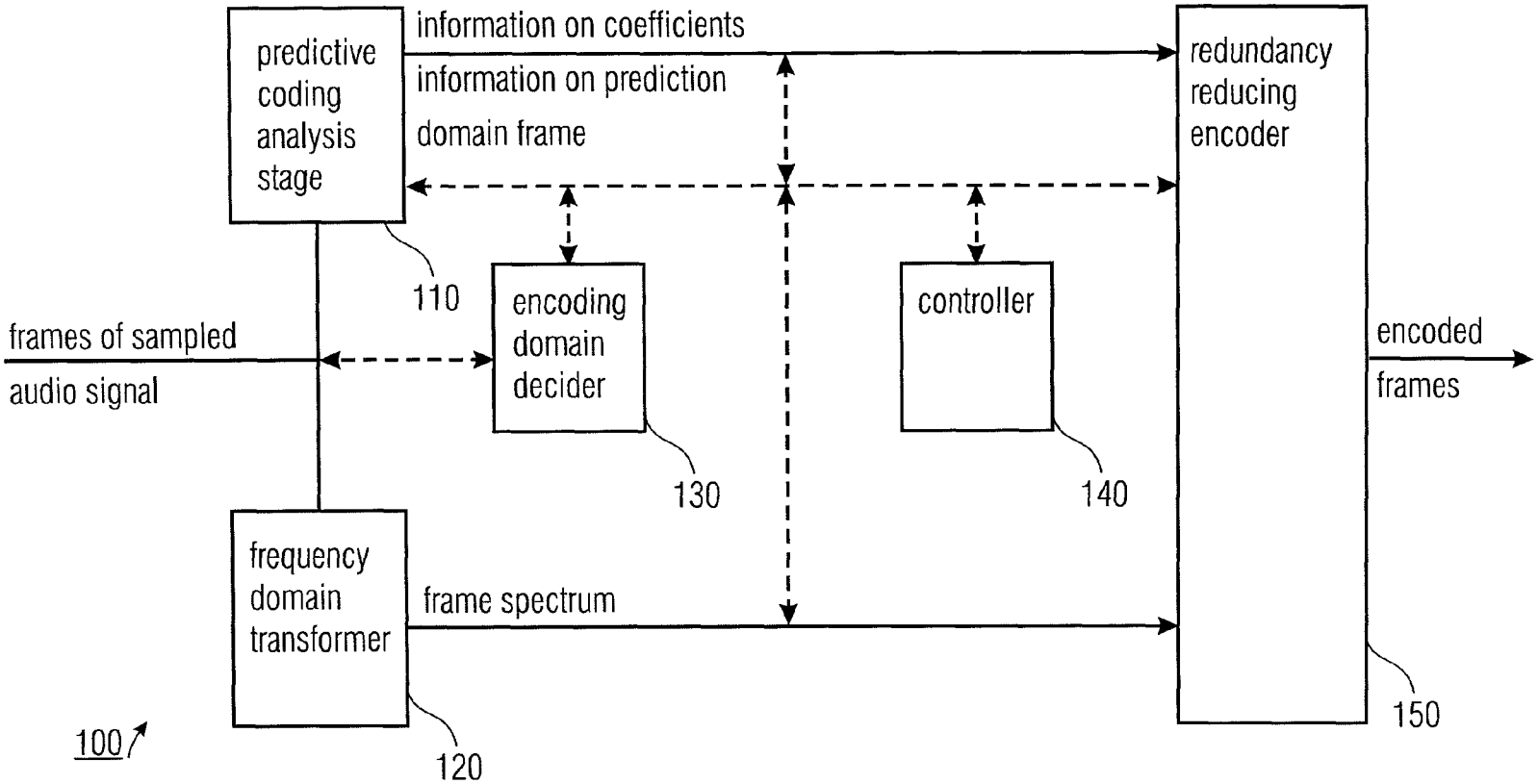
FIG. 1 shows an embodiment of an audio encoder.

FIG. 1 shows an embodiment of an audio encoder 100. The audio encoder 100 is adapted for encoding frames of a sampled audio signal to obtain encoded frames, wherein a frame comprises a number of time domain audio samples. The embodiment of the audio encoder comprises a predictive coding analysis state 110 for determining an information on coefficients of a synthesis filter and an information on a prediction domain frame based on a frame of audio samples. In embodiments the prediction domain frame may correspond to an excitation frame or a filtered version of an excitation frame. In the following it can be referred to prediction domain encoding when encoding an information on coefficients of a synthesis filter and an information on a prediction domain frame based on a frame of audio samples.

Moreover, the embodiment of the audio encoder 100 comprises a frequency domain transformer 120 for transforming a frame of audio samples to the frequency domain to obtain a frame spectrum. In the following it can be referred to transform domain encoding, when a frame spectrum is encoded. Furthermore, the embodiment of the audio encoder 100 comprises an encoding domain decider 130 for deciding, whether encoded data for a frame is based on the information on the coefficients and on the information on the prediction domain frame, or based on the frame spectrum. The embodiment of the audio encoder 100 comprises a controller 140 for determining an information on a switching coefficient, when the encoding domain decider decides that encoded data of a current frame is based on the information on the coefficients and the information on the prediction domain frame, when encoded data of a previous frame was encoded based on a previous frame spectrum. The embodiment of the audio encoder 100 further comprises a redundancy reducing encoder 150 for encoding the information on the prediction domain frame, the information on the coefficients, the information on the switching domain coefficient and/or the frame spectrum. In other words, the encoding domain decider 130 decides the encoding domain, whereas the controller 140 provides the information on the switching coefficient when switching from the transform domain to the prediction domain.

In FIG. 1 there are some connections displayed by broken lines. These indicate the different options in embodiments. For example, the information on the switching coefficients may be obtained by simply permanently running the predictive coding analysis stage 110 such that the information on coefficients and the information on prediction domain frames are available at its output. The controller 140 may then indicate to the redundancy reducing encoder 150 when to encode the output from the predictive coding analysis stage 110 and when to encode the frame spectrum output at a frequency domain transformer 120 after a switching decision has been made by the encoding domain decider 130. The controller 140 may therefore control the redundancy reducing encoder 150 to encode the information on the switching coefficient when switching from the transform domain to the prediction domain.

If the switching occurs, the controller 140 may indicate to the redundancy reducing encoder 150 to encode an overlapping frame, during a previous frame the redundancy reducing encoder 150 may be controlled by the controller 140 in a manner that a bitstream contains for the previous frame both, information on the coefficients and the information on the prediction domain frame, as well as the frame spectrum. In other words, in embodiments, the controller may control the redundancy reducing encoder 150 in a manner such that the encoded frames include the above-described information. In other embodiments, the encoding domain decider 130 may decide to change the encoding domain and switch between the predictive coding analysis stage 110 and the frequency domain transformer 120.

In these embodiments, the controller 140 may carry out some analysis internally, in order to provide the switching coefficients. In embodiments the information on a switching coefficient may correspond to an information on filter states, adaptive codebook content, memory states, information on an excitation signal, LPC coefficients, etc. The information on the switching coefficient may comprise any information that enables a warm-up or initialization of an predictive synthesis stage 220.

The encoding domain decider 130 may determine its decision on when to switch the encoding domain based on the frames or samples of audio signals which is also indicated by the broken line in FIG. 1. In other embodiments, said decision may be made on the basis of the information coefficients, the information on prediction domain frame, and/or the frame spectrum.

Generally, embodiments shall not be limited to the manner in which the encoding domain decider 130 decides when to change the encoding domain, it is more important that the encoding domain changes are decided by the encoding domain decider 130, during which the above-described problems occur, and in which in some embodiments the audio encoder 100 is coordinated in a manner that the above-described disadvantages effects are at least partly compensated.

In embodiments, the encoding domain decider 130 can be adapted for deciding based on a signal property or the properties of the audio frames. As already known, audio properties of an audio signal may determine the coding efficiency, i.e. for certain characteristics of an audio signal, it may be more efficient to use transform based encoding, for other characteristics it may be more beneficial to use prediction domain coding. In some embodiments, the encoding domain decider 130 may be adapted for deciding to use transformed based coding when the signal is very tonal or unvoiced. If the signal is transient or a voice-like signal, the encoding domain decider 130 may be adapted for deciding to use a prediction domain frame as stated for the encoding.

According to the other broken lines and arrows in FIG. 1, the controller 140 may be provided with the information on coefficients, the information on the prediction domain frame and the frame spectrum, and the controller 140 can be adapted for determining the information on the switching coefficient on the basis of said information. In other embodiments, the controller 140 may provide an information to the predictive coding analysis stage 110 in order to determine the switching coefficients. In embodiments, the switching coefficients may correspond to the information on coefficients and in other embodiments, they may be determined in a different manner.

Figure 2:
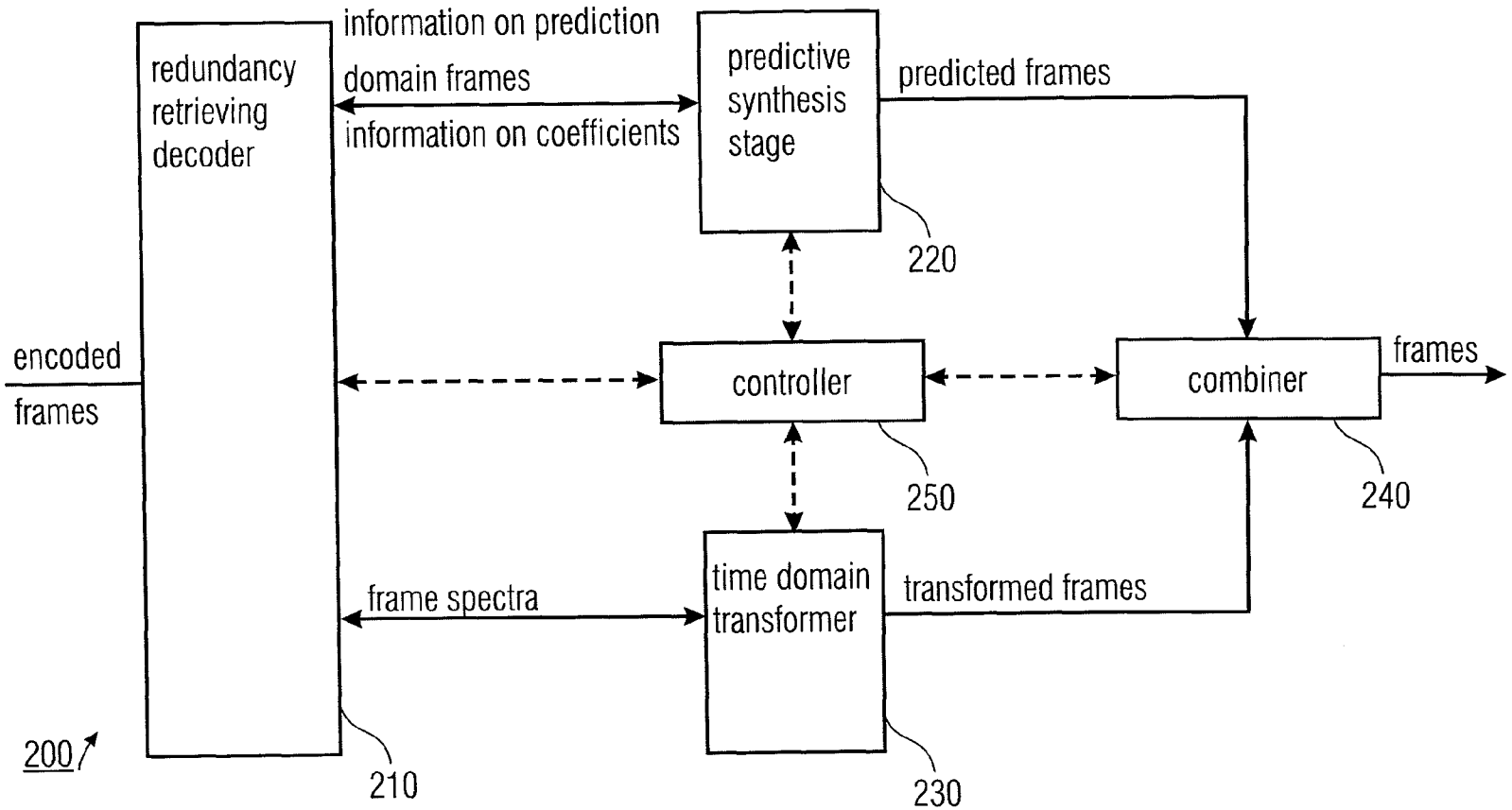
FIG. 2 shows an embodiment of an audio decoder.

FIG. 2 illustrates an embodiment of an audio decoder 200. The embodiment of the audio decoder 200 is adapted for decoding encoded frames to obtain frames of a sampled audio signal, wherein a frame comprises a number of time domain audio samples. The embodiment of the audio decoder 200 comprises a redundancy retrieving decoder 210 for decoding the encoded frames to obtain an information on a prediction domain frame, an information on coefficients for a synthesis filter and/or a frame spectrum. Moreover, the embodiment of the audio decoder 200 comprises a predictive synthesis stage 220 for determining a predicted frame of audio samples based on the information on the coefficients for the synthesis filter and the information on the prediction domain frame, and a time domain transformer 230 for transforming the frame spectrum to the time domain to obtain a transformed frame from the frame spectrum. The embodiment of the audio decoder 200 further comprises a combiner 240 for combining the transformed frame and the predicted frame to obtain the frames of the sampled audio signal.

Furthermore, the embodiment of the audio decoder 200 comprises a controller 250 for controlling a switch-over process, the switch-over process being effected when a previous frame is based on the transformed frame, and a current frame is based on the predicted frame, the controller 250 being configured for providing switching coefficients to the predictive synthesis stage 220 for training, initializing or warming-up the predictive synthesis stage 220, so that the predictive synthesis stage 220 is initialized when the switch-over process is effected.

According to the broken arrows shown in FIG. 2, the controller 250 may be adapted to control parts or all of the components of the audio decoder 200. The controller 250 may for example be adapted to coordinate the redundancy retrieving decoder 210, in order to retrieve extra information on switching coefficients or information on the previous prediction domain frame, etc. In other embodiments, the controller 250 may be adapted for deriving said information on the switching coefficients by itself, for example by being provided with the decoded frames by the combiner 240, by carrying out an LP-analysis based on the output of the combiner 240. The controller 250 may then be adapted for coordinating or controlling the predictive synthesis stage 220 and a time domain transformer 230 in order to establish the above-described overlapping frames, timing, time domain analyzing and time domain analyzing cancellation, etc.

In the following, an LPC based domain codec is considered, including predictors and internal filters which, during a start-up need a certain time to reach a state which ensures an accurate filter synthesis. In other words, in embodiments of the audio encoder 100, the predictive coding analysis stage 110 can be adapted for determining the information on the coefficients of the synthesis filter and the information on the prediction domain frame based on an LPC analysis. In embodiments of the audio decoder 200, the predictive synthesis stage 220 can be adapted for determining the predicted frames based on an LPC synthesis filter.

Using a rectangular window at the beginning of the first LPD (LPD=Linear Prediction Domain) frame and resetting the LPD-based codec to a zero state, obviously does not provide an ideal option for these transitions, because not enough time is left for the LPD codec to build up a good signal, which would introduce blocking artifacts.

In embodiments, in order to handle the transition from a non-LPD mode to an LPD mode, overlap windows can be used. In other words, in embodiments of the audio encoder 100, the frequency domain transformer 120 can be adapted for transforming the frame of audio samples based on a Fast Fourier Transform (FFT=Fast Fourier Transform), or an MDCT (MDCT=Modified Discrete Cosine Transform). In embodiments of the audio decoder 200, the time domain transformer 230 can be adapted for transforming the frame spectra to the time domain based on an inverse FFT (IFFT=inverse FFT), or an inverse MDCT (IMDCT=inverse MDCT).

Therewith, embodiments may run in a non-LPD mode, which may also be referred to as the transform based mode, or in an LPD mode, which is also referred to as the predictive analysis and synthesis. Generally, embodiments may use overlapping windows, especially when using MDCT and IMDCT. In other words, in the non-LPD mode overlapping windowing with time domain aliasing (TDA=Time Domain Aliasing) may be used. Therewith, when switching from the non-LPD mode to the LPD mode, the time domain aliasing of the last non-LPD frame can be compensated. Embodiments may introduce time domain aliasing in the original signal before carrying out LPD coding, however, time domain aliasing may not be compatible with prediction based time domain coding such as ACELP (ACELP=Algebraic Codebook Excitation Linear Prediction). Embodiments may introduce an artificial aliasing in the beginning of the LPD segment and apply time domain cancellation in the same manner as for ACELP to non-LPD transitions. In other words, predictive analysis and synthesis may be based on an ACELP in embodiments.

In some embodiments, artificial aliasing is produced from the synthesis signal instead of the original signal. Since the synthesis signal is inaccurate, especially at the LPD start-up, these embodiments may somewhat compensate the block artifacts by introducing artificial TDA, however, the introduction of artificial TDA may introduce an error of inaccuracy along with the reduction of artifacts.

Figure 3:
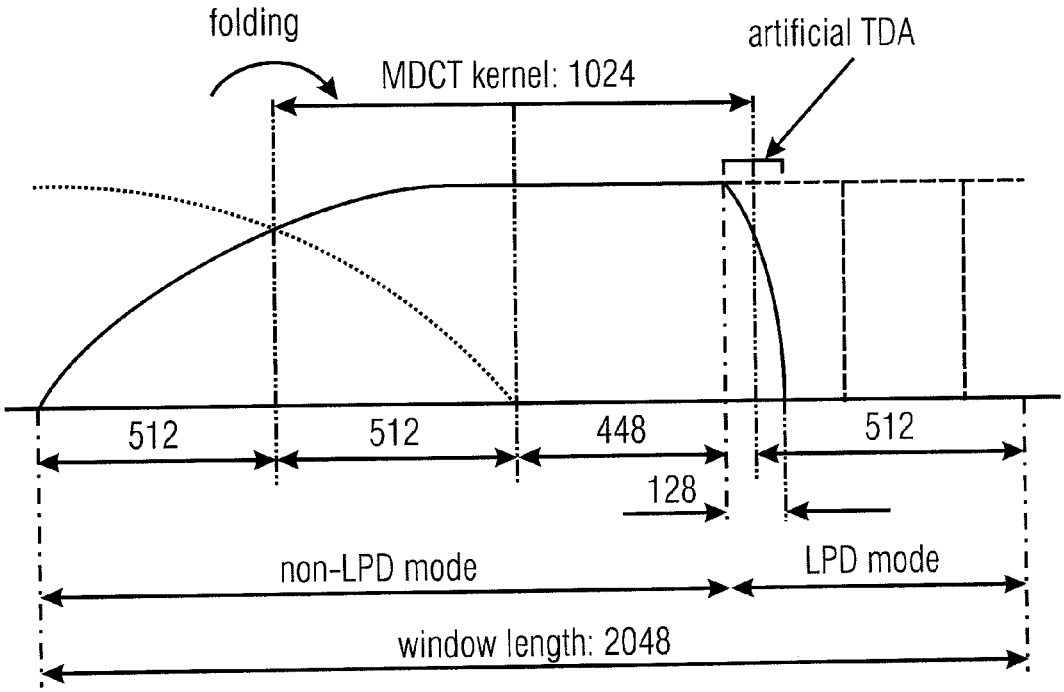
FIG. 3 shows a window shape used by an embodiment.

FIG. 3 illustrates a switch-over process within one embodiment. In the embodiment displayed in FIG. 3, it is assumed that the switch-over process switches from the non-LPD mode, for example the MDCT mode, to the LPD mode. As indicated in FIG. 3, a total window length of 2048 samples is considered. On the left-hand side of FIG. 3, the rising edge of the MDCT window is illustrated extending throughout 512 samples. During the process of MDCT and IMDCT, these 512 samples of the rising edge of the MDCT window will be folded with the next 512 samples, which are assigned in FIG. 3 to the MDCT kernel, comprising the centered 1024 samples within the complete 2048-sample window. As will be explained in more detail in the following, the time domain aliasing introduced by the process of MDCT and IMDCT is not critical when the preceding frame was also encoded in the non-LPD mode, as it is one of the advantageous properties of the MDCT that time domain aliasing can be inherently compensated by the respective consecutive overlapping MDCT windows.

However, when switching to the LPD mode, i.e. now considering the right-hand part of the MDCT window shown in FIG. 3, such time domain aliasing cancellation is not automatically carried out, since the first frame decoded in LPD mode does not automatically have the time domain aliasing to compensate with the preceding MDCT frame. Therefore, in an overlapping region, embodiments may introduce an artificial time domain aliasing, as it is indicated in FIG. 3 in the area of the 128 samples centered at the end of the MDCT kernel window, i.e. centered after 1536 samples. In other words, in FIG. 3 it is assumed that artificial time domain aliasing is introduced to the beginning, i.e. in this embodiment the first 128 samples, of the LPD mode frame, in order to compensate with the time domain aliasing introduced at the end of the last MDCT frame.

In the embodiment, the MDCT is applied in order to obtain the critically sampling switch-over from an encoding operation in one domain to an encoding operation in a different other domain, i.e. being carried out in embodiments of the frequency domain transformer 120 and/or the time domain transformer 230. However, all other transforms can be applied as well. Since, however, the MDCT is the embodiment, the MDCT will be discussed in more detail with respect to FIG. 4*a* and FIG. 4*b*.

Figure 4A:
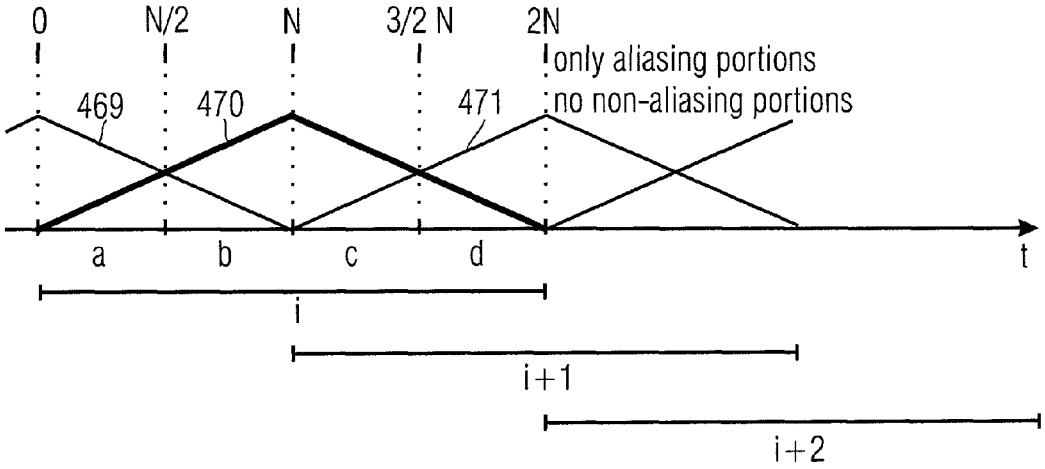
FIGS. 4*a* and 4*b* illustrate MDCT and time domain aliasing.

FIG. 4*a* illustrates a window 470, which has an increasing portion to the left and a decreasing portion to the right, where one can divide this window into four portions: a, b, c, and d. Window 470 has, as can be seen from the figure only aliasing portions in the 50% overlap/add situation illustrated. Specifically, the first portion having samples from zero to N corresponds to the second portions of a preceding window 469, and the second half extending between sample N and sample 2N of window 470 is overlapped with the first portion of window 471, which is in the illustrated embodiment window i+1, while window 470 is window i.

The MDCT operation can be seen as the cascading of windowing and the folding operation and a subsequent transform operation and, specifically, a subsequent DCT (DCT=Discrete Cosine Transform) operation, where the DCT of type-IV (DCT-IV) is applied. Specifically, the folding operation is obtained by calculating the first portion N/2 of the folding block as $-c_R-d$, and calculating the second portion of N/2 samples of the folding output as $a-b_R$, where R is the reverse operator. Thus, the folding operation results in N output values while 2N input values are received.

A corresponding unfolding operation on the decoder-side is illustrated, in equation form, in FIG. 4*a* as well.

Generally, an MDCT operation on (a,b,c,d) results in exactly the same output values as the DCT-IV of $(-c_R-d, a-b_R)$ as indicated in FIG. 4*a*.

Correspondingly, and using the unfolding operation, an IMDCT operation results in the output of the unfolding operation applied to the output of a DCT-IV inverse transform.

Therefore, time aliasing is introduced by performing a folding operation on the encoder side. Then, the result of windowing and folding operation is transformed into the frequency domain using a DCT-IV block transform requiring N input values.

On the decoder-side, N input values are transformed back into the time domain using a DCT-IV operation, and the output of this inverse transform operation is thus changed into an unfolding operation to obtain 2N output values which, however, are aliased output values.

In order to remove the aliasing which has been introduced by the folding operation and which is still there subsequent to the unfolding operation, the overlap/add operation may carry out time domain aliasing cancellation.

Therefore, when the result of the unfolding operation is added with the previous IMDCT result in the overlapping half, the reversed terms cancel in the equation in the bottom of FIG. 4*a* and one obtains simply, for example, b and d, thus recovering the original data.

In order to obtain a TDAC for the windowed MDCT, a requirement exists, which is known as "Princen-Bradley" condition, which means that the window coefficients raised to 2 for the corresponding samples which are combined in the time domain aliasing canceller as to result in unity (1) for each sample.

Figure 4B:
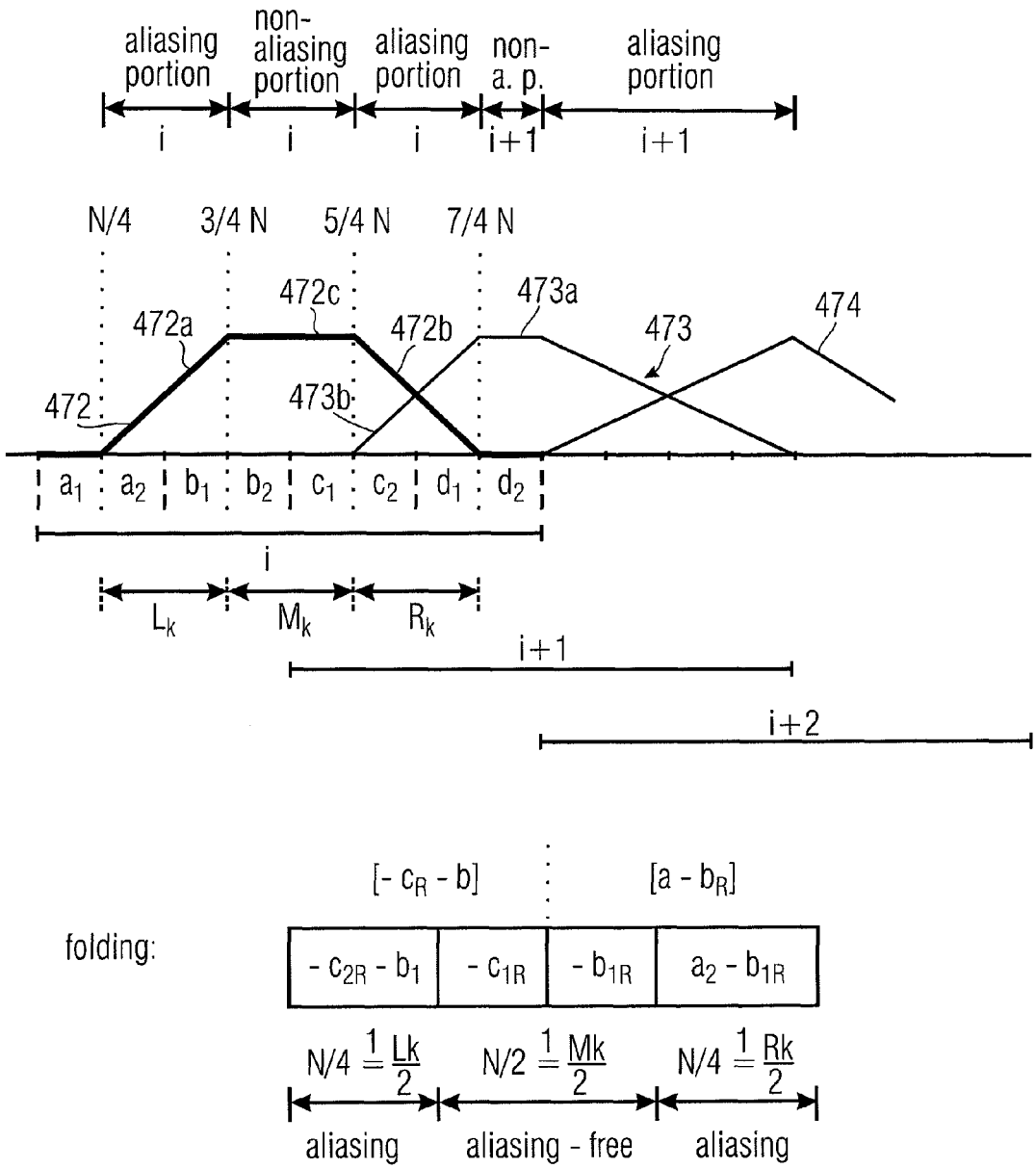

While FIG. 4*a* illustrates the window sequence as, for example, applied in the AAC-MDCT (AAC=Advanced Audio Coding) for long windows or short windows, FIG. 4*b* illustrates a different window function which has, in addition to aliasing portions, a non-aliasing portion as well.

FIG. 4*b* illustrates an analysis window function 472 having a zero portion a1 and d2, having an aliasing portion 472*a*, 472*b*, and having a non-aliasing portion 472*c*.

The aliasing portion 472*b* extending over c2, d1 has a corresponding aliasing portion of a subsequent window 473, which is indicated at 473*b*. Correspondingly, window 473 additionally comprises a non-aliasing portion 473*a*. FIG. 4*b*, when compared to FIG. 4*a* makes clear that, due to the fact that there are zero portions a1, d1, for window 472 or c1 for window 473, both windows receive a non-aliasing portion, and the window function in the aliasing portion is steeper than in FIG. 4*a*. In view of that, the aliasing portion 472*a* corresponds to $L_k$, the non-aliasing portion 472*c* corresponds to portion $M_k$, and the aliasing portion 472*b* corresponds to $R_k$ in FIG. 4*b*.

When the folding operation is applied to a block of samples windowed by window 472, a situation is obtained as illustrated in FIG. 4*b*. The left portion extending over the first N/4 samples has aliasing. The second portion extending over N/2 samples is aliasing-free, since the folding operation is applied on window portions having zero values, and the last N/4 samples are, again, aliasing-affected. Due to the folding operation, the number of output values of the folding operation is equal to N, while the input was 2N, although, in fact, N/2 values in this embodiment were set to zero due to the windowing operation using window 472.

Now, the DCT-IV is applied to the result of the folding operation, but, importantly, the aliasing portion 472, which is at the transition from one coding mode to the other coding mode is differently processed than the non-aliasing portion, although both portions belong to the same block of audio samples and, importantly, are input into the same block transform operation.

FIG. 4*b* furthermore illustrates a window sequence of windows 472, 473, 474, where the window 473 is a transition window from a situation where there do exist non-aliasing portions to a situation, where only exist aliasing portions. This is obtained by asymmetrically shaping the window function. The right portion of window 473 is similar to the right portion of the windows in the window sequence of FIG. 4*a*, while the left portion has a non-aliasing portion and the corresponding zero portion (at c1). Therefore, FIG. 4*b* illustrates a transition from MDCT-TCX to AAC, when AAC is to be performed using fully-overlapping windows or, alternatively, a transition from AAC to MDCT-TCX is illustrated, when window 474 windows a TCX data block in a fully-overlapping manner, which is the regular operation for MDCT-TCX on the one hand and MDCT-AAC on the other hand when there is no reason for switching from one mode to the other mode.

Therefore, window 473 can be termed to be a "stop window", which has, in addition, the characteristic that the length of this window is identical to the length of at least one neighboring window so that the general block pattern or framing raster is maintained, when a block is set to have the same number as window coefficients, i.e., 2N samples in the FIG. 4*a* or FIG. 4*b* example.

Figure 5:
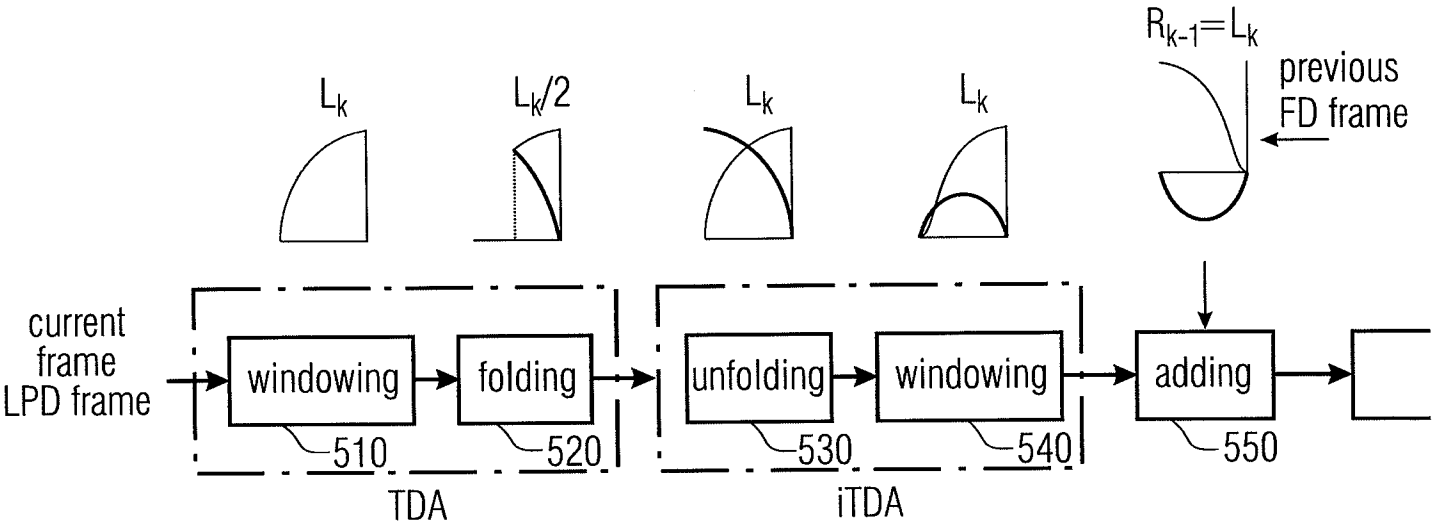
FIG. 5 illustrates a block diagram of an embodiment for time domain aliasing cancellation.

In the following, the method of artificial time domain aliasing and time domain aliasing cancellation will be described in detail. FIG. 5 shows a block diagram, which may be utilized in an embodiment, displaying a signal processing chain. FIGS. 6*a* to 6*g* and 7*a* to 7*g* illustrate sample signals, where FIGS. 6*a* to 6*g* illustrate a principle process of time domain aliasing cancellation assuming that the original signal is used, wherein FIGS. 7*a* to 7*g* signal samples are illustrated which are determined based on the assumption that the first LPD frame results after a full reset and without any adaptation.

Figure 6A:
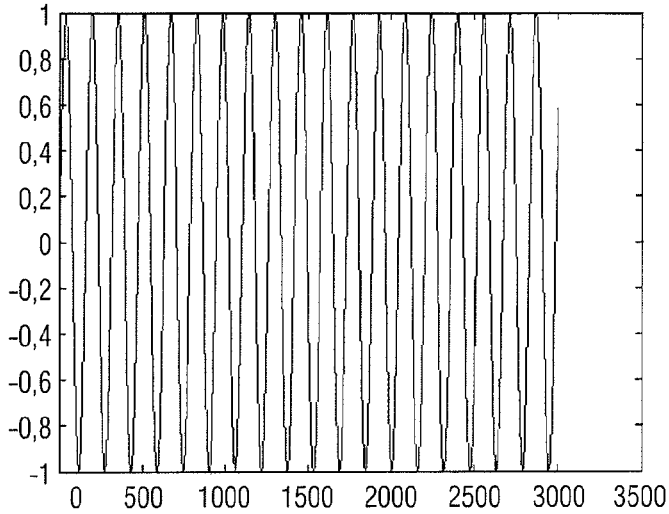
FIGS. 6*a*-6*g* illustrate signals being processed for time domain aliasing cancellation in an embodiment.
Figure 6B:
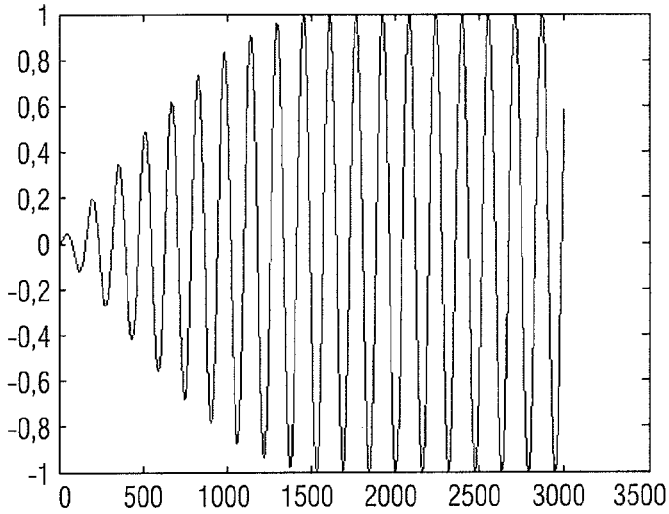
Figure 6C:
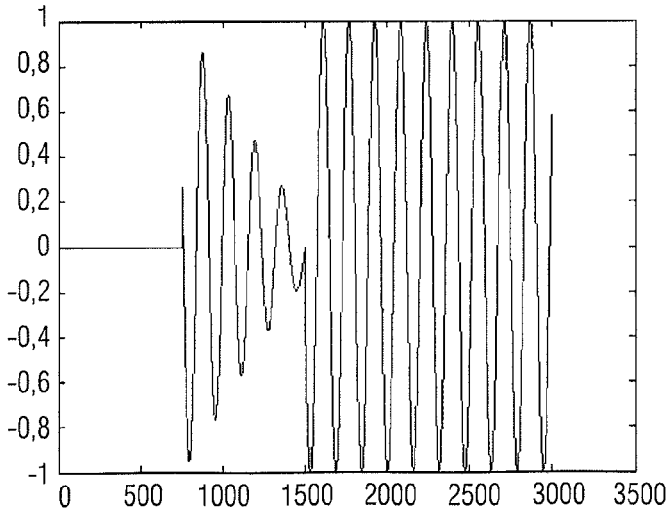
Figure 6D:
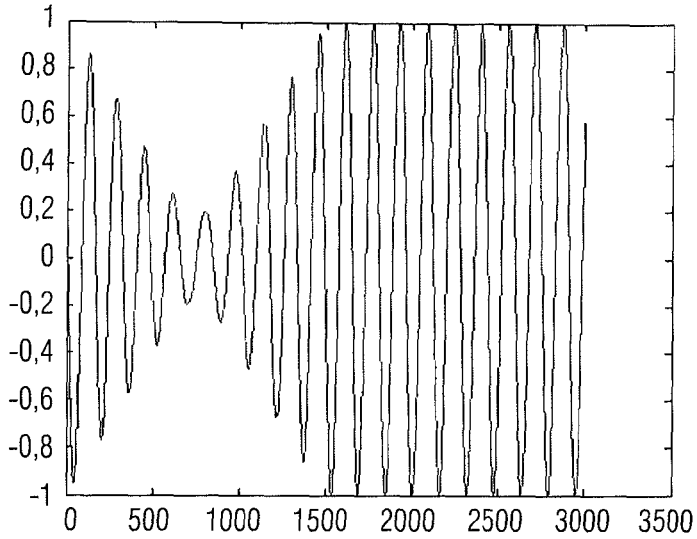
Figure 7A:
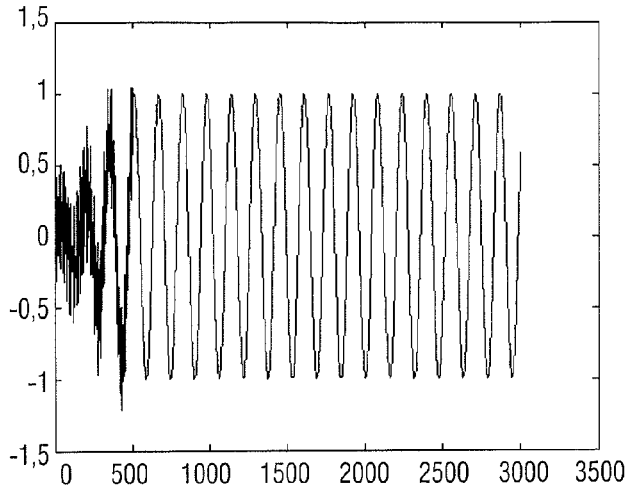
FIGS. 7*a*-7*g* illustrate a signal processing chain for a time domain aliasing cancellation in an embodiment when using a linear prediction decoder.
Figure 7B:
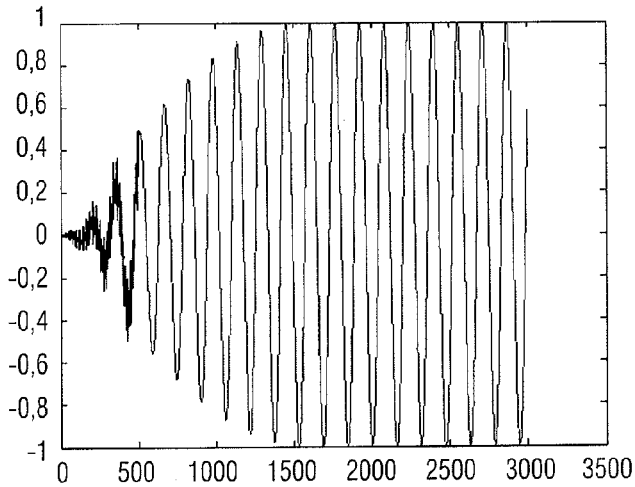
Figure 7C:
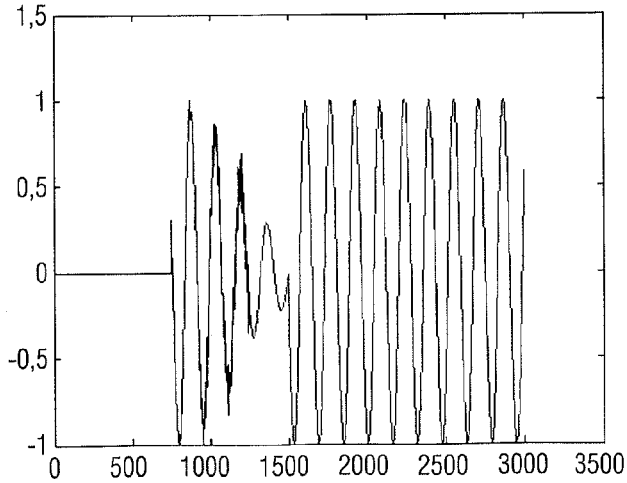
Figure 7D:
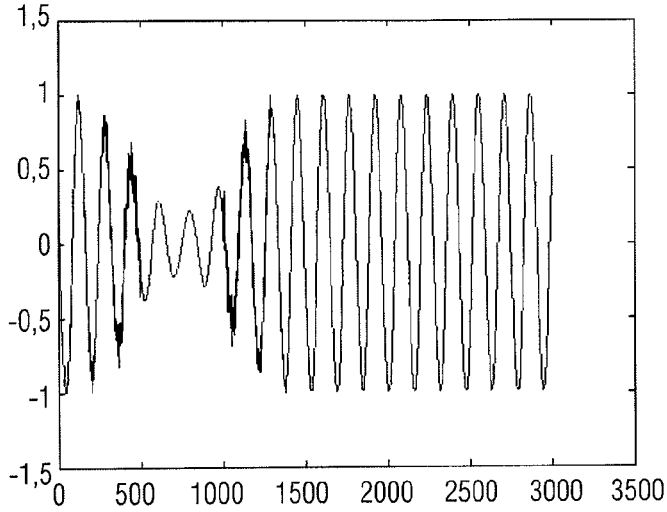

In other words, FIG. 5 illustrates an embodiment of a process of introducing artificial time domain aliasing and time domain aliasing cancellation for the first frame in LPD mode in case of transition from non-LPD mode to LPD mode. FIG. 5 shows that first a windowing is applied to the current LPD frame in block 510. As FIGS. 6*a*, 6*b*, and FIGS. 7*a*, 7*b* illustrate, the windowing corresponds to a fade in of the respective signals. As illustrated in the small view graph above the windowing block 510 in FIG. 5, it is supposed that windowing is applied to $L_k$ samples. The windowing 510 is followed by a folding operation 520, which results in $L_k/2$ samples. The result of the folding operation is illustrated in FIGS. 6*c* and 7*c*. It can be seen that due to the reduced number of samples, there is a zero period extending across $L_k/2$ samples at the beginning of the respective signals.

Figure 6E:
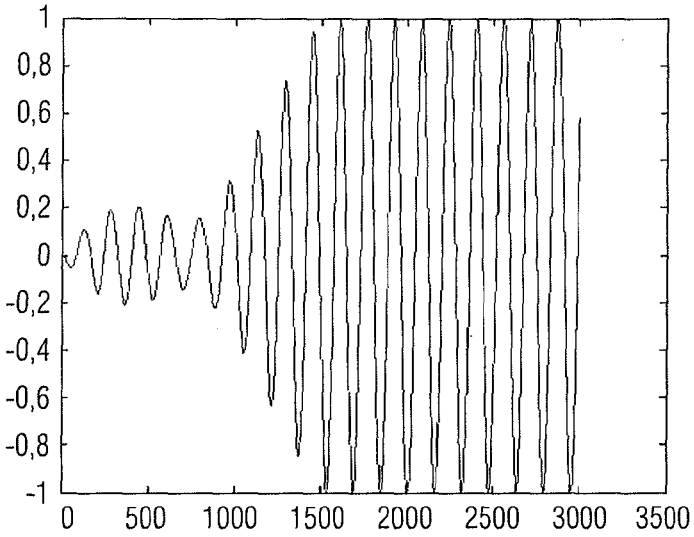
Figure 6F:
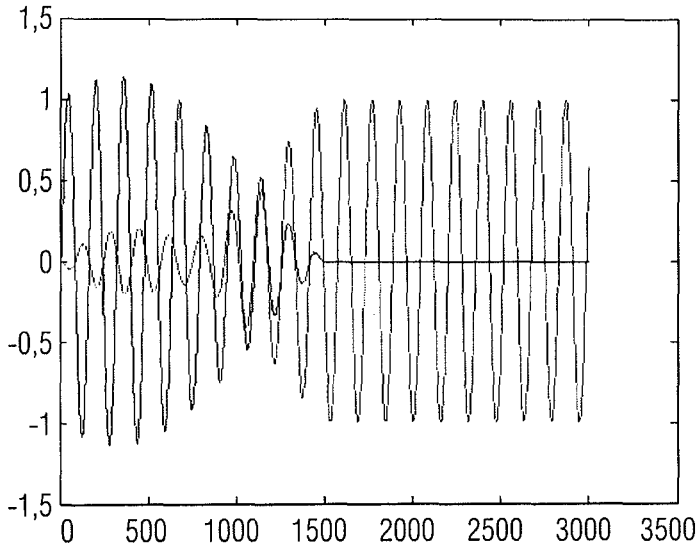
Figure 7E:
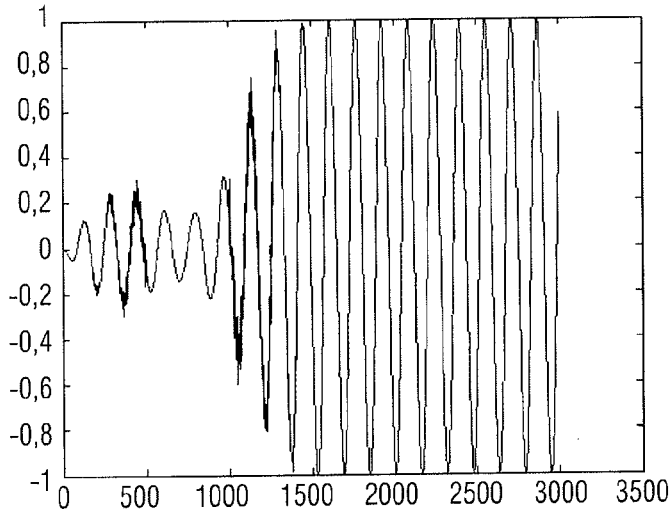

The operations of windowing in block 510 and folding in block 520 can be summarized as the time domain aliasing which is introduced through MDCT. However, further aliasing effects arise when inversely transforming through IMDCT. Effects evoked by the IMDCT are summarized in FIG. 5 by blocks 530 and 540, which can again be summarized as the inversed time domain aliasing. As shown in FIG. 5, unfolding is then carried out in block 530, which results in doubling the number of samples, i.e. in $L_k$ samples result. The respective signals are displayed in FIGS. 6*d* and 7*d*. It can be seen from FIGS. 6*d* and 7*d* that the numbers of samples have been doubled, and time aliasing has been introduced. The operation of unfolding 530 is followed by another windowing operation 540, in order to fade in the signals. The results of the second windowing 540 are displayed in FIGS. 6*e* and 7*e*. Finally, the artificially time aliased signals displayed in FIGS. 6*e* and 7*e* are overlapped and added to the previous frame encoded in the non-LPD mode, which is indicated by block 550 in FIG. 5, and the respective signals are displayed in FIGS. 6*f* and 7*f*.

In other words, in embodiments of the audio decoder 200, the combiner 240 can be adapted to carry out the functions of block 550 in FIG. 5.

Figure 6G:
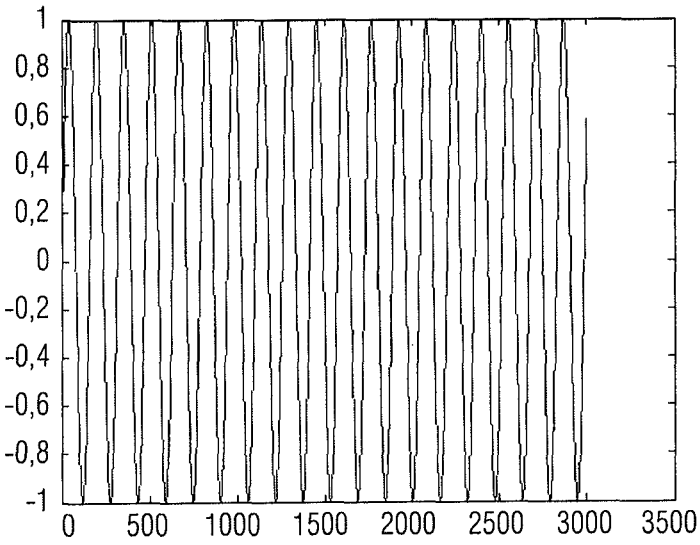
Figure 7F:
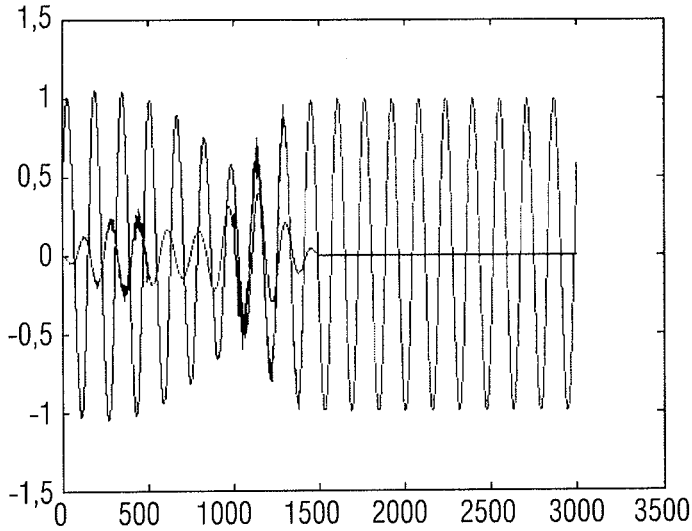
Figure 7G:
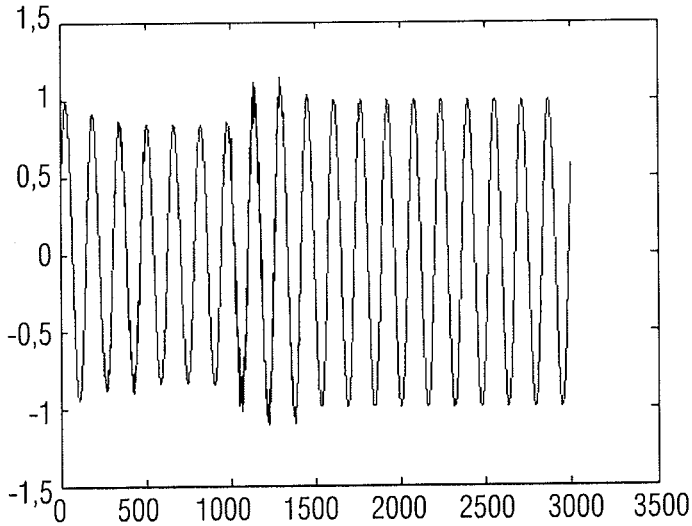

The resulting signals are displayed in FIGS. 6*g* and 7*g*. Summarizing, in both cases the left part of the respective frame is windowed, indicated by FIGS. 6*a*, 6*b*, 7*a*, and 7*b*. The left part of the window is then folded which is indicated in FIGS. 6*c* and 7*c*. After unfolding, cf. 6*d* and 7*d*, another windowing is applied, cf. FIGS. 6*e* and 7*e*. FIGS. 6*f* and 7*f* show the current process frame with the shape of the previous non-LPD frame and FIGS. 6*g* and 7*g* show the results after an overlap and add operation. From FIGS. 6*a* to 6*g* it can be seen that a perfect reconstruction can be achieved by embodiments after applying an artificial TDA on the LPD frame and applying the overlap and add with the previous frame. However, in the second case, i.e. the case illustrated in FIGS. 7*a* to 7*g*, reconstruction is not perfect. As already mentioned above, it was assumed that in the second case, the LPD mode was fully reset, i.e. states and memories of the LPC synthesis were set to zero. This results in the synthesis signal not being accurate during the first samples. In this case the artificial TDA plus the overlap adding results in distortions and artifacts, rather than in a perfect reconstruction, cf. FIGS. 6*g* and 7*g*.

Figure 8A:
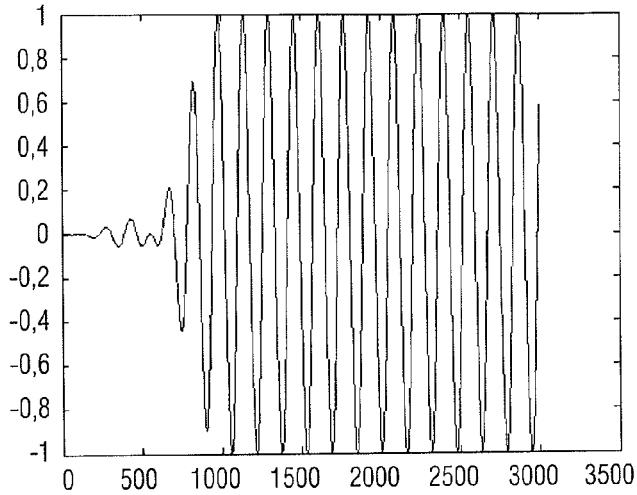
FIGS. 8*a*-8*g* illustrate a signal processing chain in an embodiment with time domain aliasing cancellation.
Figure 8B:
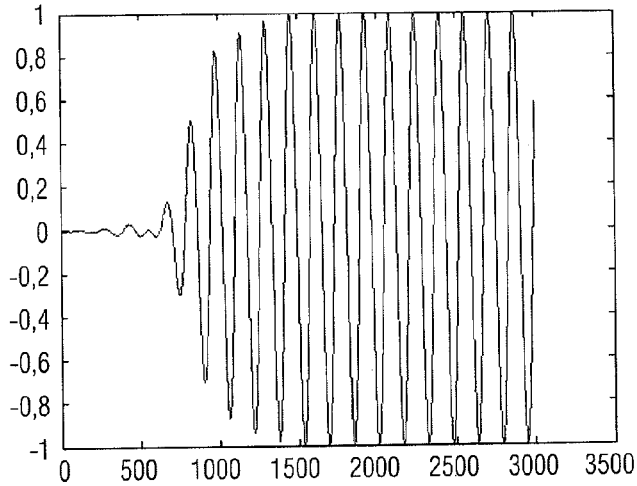
Figure 8C:
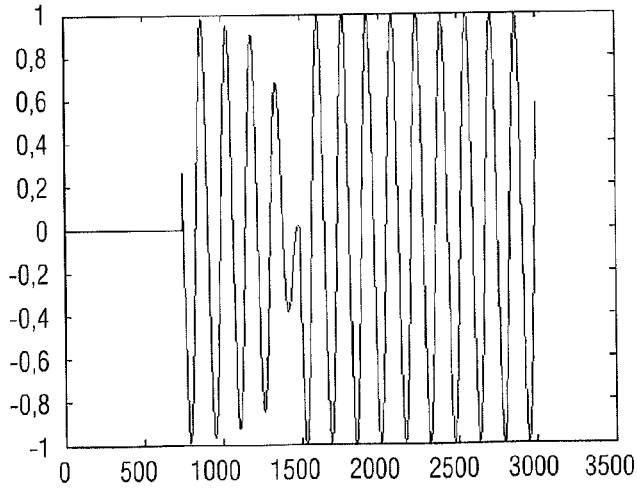
Figure 8D:
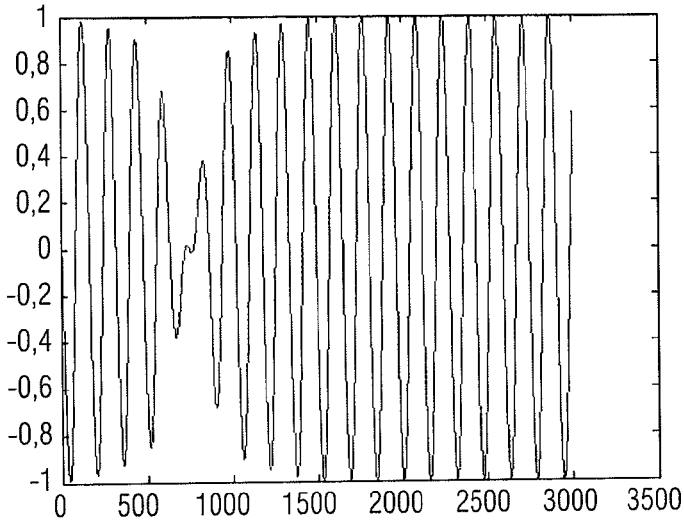
Figure 8E:
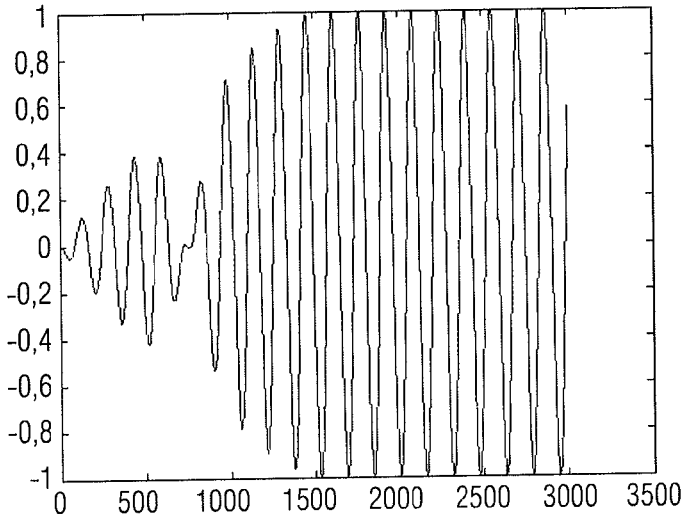
Figure 8F:
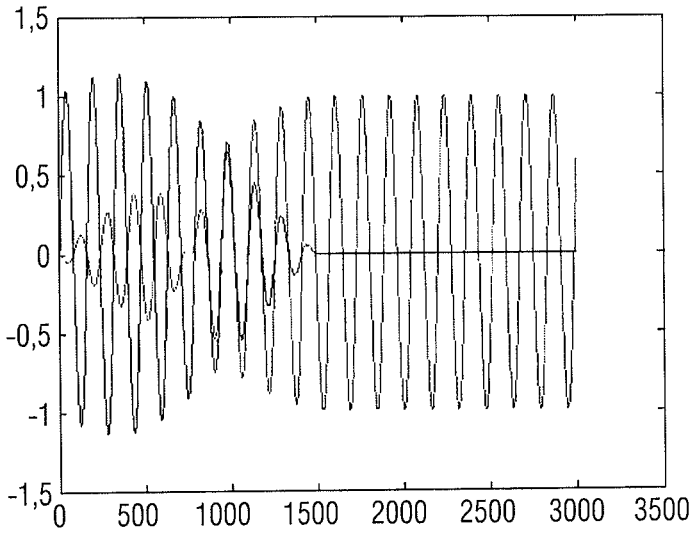
Figure 8G:
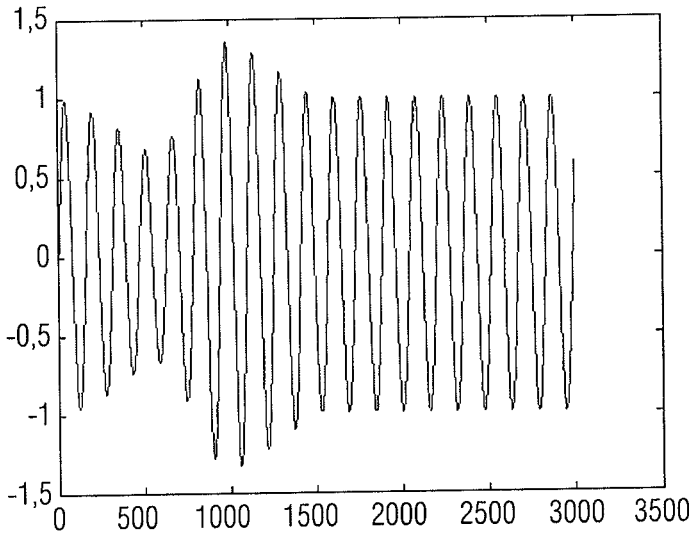

FIGS. 6*a* to 6*g* and 8*a* to 8*g* illustrate another comparison between using the original signal for artificial time domain aliasing and time domain aliasing cancellation, and another case of using the LPD start-up signal, however, in FIGS. 8*a* to 8*g*, it was assumed that the LPD start-up period takes longer than it takes in FIGS. 7*a* to 7*g*. FIGS. 6*a* to 6*g* and 8*a* to 8*g* illustrate graphs of sample signals to which the same operations have been applied as was already explained with respect to FIG. 5. Comparing FIGS. 6*g* and 8*g*, it can be seen that the distortions and artifacts introduced to the signal displayed in FIG. 8*g* are even more significant than those in FIG. 7*g*. The signal displayed in FIG. 8*g* contains a lot of distortions during a relatively long time. Just for comparison, FIG. 6*g* shows the perfect reconstruction when considering the original signal for time domain aliasing cancellation.

Embodiments of the present invention may speed up the start-up period for example of an LPD core codec, as an embodiment of the predictive coding analysis stage 110, the predictive synthesis stage 220, respectively. Embodiments may update all the concerned memories and states in order to enable the reduction of a synthesized signal as close as possible to the original signal, and reduce the distortions as displayed in FIGS. 7*g* and 8*g*. Moreover, in embodiments longer overlap and add periods may be enabled, which are possible because of the improved introduction of time domain aliasing and time domain aliasing cancellation.

As it has already been described above, using a rectangular window at the beginning of the first or the current LPD frame and resetting the LPD-based codec to a zero state, may not be the ideal option for transitions. Distortions and artifacts may occur, since not enough time may be left for the LPD codec to build up a good signal. Similar considerations hold for setting the internal state variables of the codec to any defined initial values, since a steady state of such a coder depends on multiple signal properties, and start-up times from any predefined but fixed initial state can be long.

In embodiments of the audio encoder 100, the controller 140 can be adapted for determining information on coefficients for a synthesis filter and an information on a switching prediction domain frame based on an LPC analysis. In other words, embodiments may use a rectangular window and reset the internal state of the LPD codec. In some embodiments, the encoder may include information on filter memories and/or an adaptive codebook used by ACELP, about synthesis samples from the previous non-LPD frame into the encoded frames and provide them to the decoder. In other words, embodiments of the audio encoder 100 may decode the previous non-LPD frame, perform an LPC analysis, and apply the LPC analysis filter to the non-LPD synthesis signal for providing information thereon to the decoder.

As already mentioned above, the controller 140 can be adapted for determining the information on the switching coefficient such that said information may represent a frame of audio samples overlapping the previous frame.

In embodiments, the audio encoder 100 can be adapted for encoding such information on switching coefficients using the redundancy reducing encoder 150. As part of one embodiment, the restart procedure may be enhanced by transmitting or including additional parameter information of LPC computed on the previous frame in the bitstream. The additional set of LPC coefficients may in the following be referred to as LPC0.

In one embodiment, the codec may operate in its LPD core coding mode, using four LPC filters, namely LPC1 to LPC4, which are estimated or determined for each frame. In an embodiment, at transitions from non-LPD coding to LPD coding, an additional LPC filter LPC0, which may correspond to an LPC analysis centered at the end of the previous frame, may also be determined, or estimated. In other words, in an embodiment, the frame of audio samples overlapping the previous frame may be centered at the end of the previous frame.

In embodiments of the audio decoder 200, the redundancy retrieving decoder 210 can be adapted for decoding an information on the switching coefficient from the encoded frames. Accordingly, the predictive synthesis stage 220 can be adapted for determining a switch-over predicted frame which overlaps the previous frame. In another embodiment, the switch-over predicted frame may be centered at the end of the previous frame.

In embodiments, the LPC filter corresponding to the end of the non-LPD segment or frame, i.e. LPC0, may be used for the interpolation of the LPC coefficients or for computation of the zero input response in case of an ACELP.

As mentioned above, this LPC filter may be estimated in a forward manner, i.e. estimated based on the input signal, quantized by the encoder and transmitted to the decoder. In other embodiments, the LPC filter can be estimated in a backward manner, i.e. by the decoder based on the past synthesized signal. Forward estimation may use additional bitrates but may also enable a more efficient and reliable start-up period.

In other words, in other embodiments the controller 250 within an embodiment of the audio decoder 200 can be adapted for analyzing the previous frame to obtain previous frame information on coefficients for a synthesis filter and/or a previous frame information on a prediction domain frame. The controller 250 may further be adapted for providing the previous frame information on coefficients to the predictive synthesis stage 220 as switching coefficients. The controller 250 may further provide the previous frame information on the prediction domain frame to the predictive synthesis stage 220 for training.

In embodiments wherein the audio encoder 100 provides information on the switching coefficients, the amount of bits in the bitstream may increase slightly. Carrying out analysis at the decoder may not increase the amount of bits in the bitstream. However, carrying out analysis at the decoder may introduce extra complexity. Therefore, in embodiments, the resolution of the LPC analysis may be enhanced by reducing the spectral dynamic, i.e. the frames of the signal can be first preprocessed through a pre-emphasis filter. The inverse low frequency emphasis can be applied at the embodiment of the decoder 200, as well as in the audio encoder 100 to allow for the obtaining of an excitation signal or prediction domain frame needed for the encoding of the next frames. All these filters may give a zero state response, i.e. the output of a filter due to the present input given that no past inputs have been applied, i.e. given that the state information in the filter is set to zero after a full reset. Generally, when the LPD coding mode is running normally, the state information in the filter is updated by the final state after the filtering of the previous frame. In embodiments, in order to set the internal filter state of the LPD coded in a way that already for the first LPD frame all the filters and predictors are initialized to run in the optimal or improved mode for the first frame, either information on the switching coefficient/coefficients may be provided by the audio encoder 100, or additional processing may be carried out at a decoder 200.

Generally, filters and predictors for the analysis, as carried out in the audio encoder 100 by the predictive coding analysis stage 110 are distinguished from the filters and predictors used on the audio decoder 200 side for the synthesis.

Figure 9A:
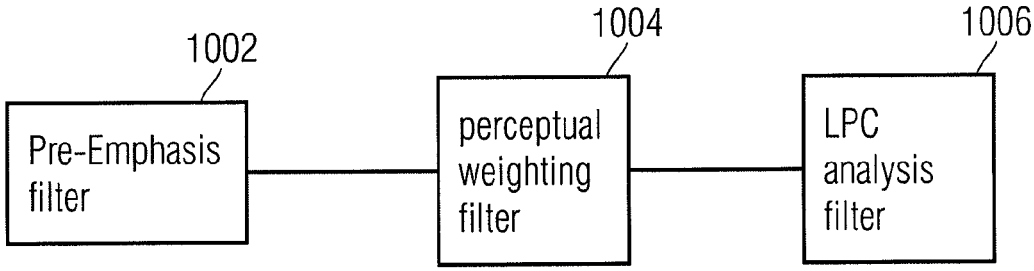
FIGS. 9*a* and 9*b* illustrate signal processing on the encoder and decoder side in embodiments.

For the analysis, as for example the predictive coding analysis stage 110, all or at least one of these filters may be fed with the appropriate original samples of the previous frame to update the memories. FIG. 9*a* illustrates an embodiment of a filter structure used for the analysis. The first filter is a pre-emphasis filter 1002, which may be used for enhancing the resolution of the LPC analysis filter 1006, i.e. the predictive coding analysis stage 110. In embodiments, the LPC analysis filter 1006 may compute or evaluate the short term filter coefficients using for example the high pass filtered speech samples within the analysis window. In other words, in embodiments, the controller 140 can be adapted for determining the information on the switching coefficient based on a high pass filtered version of a decoded frame spectrum of the previous frame. In a similar manner, supposing that analysis is carried out at the embodiment of the audio decoder 200, the controller 250 can be adapted for analyzing a high pass filtered version of the previous frame.

As illustrated in FIG. 9*a*, the LP analysis filter 1006 is preceded by a perceptual weighting filter 1004. In embodiments, the perceptual weighting filter 1004 may be employed in the analysis-by-synthesis search of codebooks. The filter may exploit the noise masking properties of the formants, as for example the vocal tract resonances, by weighting the error less in regions close to the formant frequencies and more in regions distant from them. In embodiments, the redundancy reducing encoder 150 may be adapted for encoding based on a codebook being adaptive to the respective prediction domain frame/frames. Correspondingly, the redundancy introducing decoder 210 may be adapted for decoding based on a codebook being adapted to the samples of the frames.

Figure 9B:
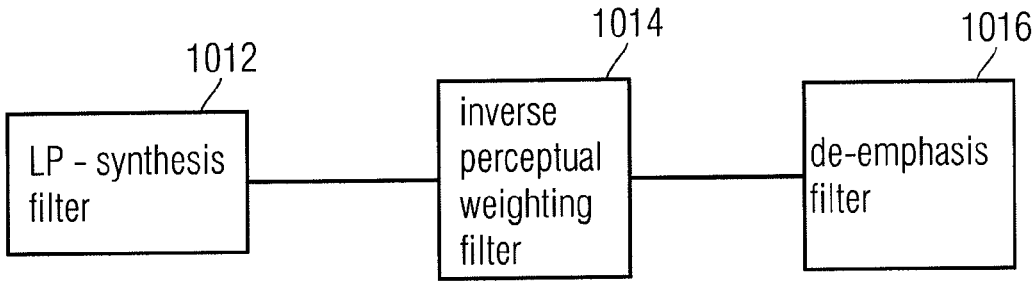

FIG. 9*b* illustrates a block diagram of the signal processing in the synthesis case. In the synthesis case, in embodiments all or at least one of the filters may be fed with the appropriate synthesized samples of the previous frame to update the memories. In embodiments of the audio decoder 200, this may be straightforward because the synthesis of the previous non-LPD frame is directly available. However, in an embodiment of the audio encoder 100, synthesis may not be carried out by default and correspondingly, the synthesized samples may not be available. Therefore, in embodiments of the audio encoder 100, the controller 140 may be adapted for decoding the previous non-LPD frame. Once the non-LPD frame has been decoded, in both embodiments, i.e. the audio encoder 100 and the audio encoder 200, synthesis of the previous frame may be carried out according to FIG. 9*b* in block 1012. Moreover, the output of the LP synthesis filter 1012 may be input to an inverse perceptual weighting filter 1014, after which a de-emphasis filter 1016 is applied. In embodiments, an adapted codebook may be used and populated with the synthesized samples from the previous frame. In further embodiments, the adaptive codebook may contain excitation vectors that are adapted for every sub-frame. The adaptive codebook may be derived from the long-term filter state. A lag value may be used as an index into the adaptive codebook. In embodiments, for populating the adaptive codebook, the excitation signal or residual signal may finally be computed by filtering the quantized weighted signal to the inverse weighting filter with zero memory. The excitation may in particular be needed at the encoder 100 in order to update the long-term predictor memory.

Embodiments of the present invention can provide the advantage that a restart procedure of filters can be boosted or accelerated by providing additional parameters and/or feeding the internal memories of an encoder or decoder with samples of the previous frame coded by the transform based coder.

Embodiments may provide the advantage of a speed-up of the start procedure of an LPC core codec by updating all or parts of the concerned memories, resulting in a synthesized signal, which may be closer to the original signal than when using conventional concepts, especially when using full reset. Furthermore, embodiments may allow a longer overlap and add window and therewith enable the improved use of time domain aliasing cancellation. Embodiments may provide the advantage that an unsteady phase of a speech coder may be shortened, the produced artifacts during the transition from a transform based coder to a speech coder may be reduced.

Depending on certain implementation requirements of the inventive methods, the inventive methods can be implemented in hardware or in software. The implementation can be performed using a digital storage medium, in particular a disk, a DVD, a CD, having electronically readable control signals stored thereon, which cooperate (or are capable of cooperating) with a programmable computer system such that the respective methods are performed.

Generally, the present invention is therefore, a computer program product with a program code stored on a machine readable carrier, the program code being operative for performing one of the methods when the computer program product runs on a computer.

In other words, the inventive methods are, therefore, a computer program having a program code for performing at least one of the inventive methods when the computer program runs on a computer.

While the aforegoing has been particularly shown and described with reference to particular embodiments thereof, it is to be understood by those skilled in the art that various other changes in the form and details may be made, without departing from the spirit and scope thereof. It is to be understood that various changes may be made in adapting to different embodiments without departing from the broader concepts disclosed herein and comprehended by the claims that follow.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. An audio encoder apparatus adapted for encoding frames of a sampled audio signal to acquire encoded frames, wherein a frame comprises a number of time domain audio samples, comprising:

a predictive coding analysis stage for determining information on coefficients of a synthesis filter and information on a prediction domain frame based on a frame of audio samples;

a frequency domain transformer for transforming a frame of audio samples to the frequency domain to acquire a frame spectrum;

an encoding domain decider for deciding whether encoded data for a frame is based on the information on the coefficients and on the information on the prediction domain frame, or based on the frame spectrum;

a controller for determining information on a switching coefficient when the encoding domain decider decides that encoded data of a current frame is based on the information on the coefficients and the information on the prediction domain frame when encoded data of a previous frame was encoded based on a previous frame spectrum acquired by the frequency domain transformer; and a redundancy reducing encoder for encoding the information on the prediction domain frame, the information on the coefficients, the information on the switching coefficient and/or the frame spectrum, wherein the information on the switching coefficient comprises an information enabling an initialization of a predictive synthesis stage, and the controller is adapted for determining the information on the switching coefficient based on an LPC analysis of the previous frame, and the controller is adapted for determining the information on the switching coefficient based on a high pass filtered version of a decoded frame spectrum of the previous frame, wherein at least one of the predictive coding analysis stage, the frequency domain transformer, the encoding domain decider, the controller and the redundancy reducing encoder comprises a hardware implementation.

2. The audio encoder apparatus of claim 1, wherein the predictive coding analysis stage is adapted for determining the information on the coefficients of the synthesis filter and the information on the prediction domain frame based on an LPC (LPC=Linear Prediction Coding) analysis and/or wherein the frequency domain transformer is adapted for transforming the frame of audio samples based on a Fast Fourier Transform or a modified discrete cosine transform.

3. The audio encoder apparatus of claim 1, wherein the controller is adapted for determining as information on the switching coefficient information on coefficients for a synthesis filter and information on a switching prediction domain frame based on the LPC analysis.

4. The audio encoder apparatus of claim 1, wherein the controller is adapted for determining the information on the switching coefficient such that the switching coefficient represent a frame of audio samples overlapping the previous frame.

5. The audio encoder apparatus of claim 4, in which the frame of audio samples overlapping the previous frame is centered at the end of the previous frame.

6. A method for encoding frames of a sampled audio signal to acquire encoded frames, wherein a frame comprises a number of time domain audio samples, comprising:

determining, performed by a predictive coding analysis stage, information on coefficients of a synthesis filter and information on a prediction domain frame based on a frame of audio samples;

transforming, performed by a frequency domain transformer, a frame of audio samples to the frequency domain to acquire a frame spectrum;

deciding, performed by an encoding domain decider, whether encoded data for a frame is based on the information on the coefficients and on the information on the prediction domain frame, or based on the frame spectrum;

determining, performed by a controller, information on a switching coefficient when it is decided that encoded data of a current frame is based on the information on the coefficients and the information on the prediction domain frame when encoded data of a previous frame was encoded based on a previous frame spectrum acquired by the frequency domain transformer; and encoding, performed by a redundancy reducing encoder, the information on the prediction domain frame, the information on the coefficients, the information on the switching coefficient and/or the frame spectra, wherein the information on the switching coefficient comprises an information enabling an initialization of a predictive synthesis stage, and the determination of the information on the switching coefficient is performed based on an LPC analysis of the previous frame, and the controller is adapted for determining the information on the switching coefficient based on a high pass filtered version of a decoded frame spectrum of the previous frame, wherein at least one of the predictive coding analysis stage, the frequency domain transformer, the encoding domain decider, the controller and the redundancy reducing encoder comprises a hardware implementation.

7. An audio decoder apparatus for decoding encoded frames to acquire frames of a sampled audio signal, wherein a frame comprises a number of time domain audio samples, comprising:

a redundancy retrieving decoder for decoding the encoded frames to acquire information on a prediction domain frame, information on coefficients for a synthesis filter and/or a frame spectrum;

a predictive synthesis stage for determining a predicted frame of audio samples based on the information on the coefficients for the synthesis filter and the information on the prediction domain frame;

a time domain transformer for transforming the frame spectrum to the time domain to acquire a transformed frame from the frame spectrum;

a combiner for combining the transformed frame and the predicted frame to acquire the frames of the sampled audio signal; and a controller for controlling a switch-over process, the switch-over process being effected when a previous frame is based on a transformed frame and a current frame is based on a predicted frame, the controller being configured for providing a switching coefficient to the predictive synthesis stage for initialization of the predictive synthesis stage by estimating an LPC filter corresponding to an end of the previous frame so that the predictive synthesis stage is initialized when the switch-over process is effected, wherein at least one of the redundancy retrieving decoder, the predictive synthesis stage, the time domain transformer, the combiner and the controller comprises a hardware implementation.

8. The audio decoder apparatus of claim 7, wherein the redundancy retrieving decoder is adapted for decoding an information on the switching coefficient from the encoded frames.

9. The audio decoder apparatus of claim 7, wherein the predictive synthesis stage is adapted for determining the predictive frame based on an LPC synthesis and/or wherein the time domain transformer is adapted for transforming the frame spectrum to the time domain based on an inverse FFT or an inverse MDCT.

10. The audio decoder apparatus of claim 7, wherein the controller is adapted for analyzing the previous frame to acquire a previous frame information on coefficients for a synthesis filter and a previous frame information on a prediction domain frame and wherein the controller is adapted for providing the previous frame information on coefficients to the predictive synthesis stage as switching coefficient and/or wherein the controller is adapted for further providing the previous frame information on the prediction domain frame to the predictive synthesis stage for training.

11. The audio decoder apparatus of claim 7, wherein the predictive synthesis stage is adapted for determining a switch-over prediction frame which is centered at the end of the previous frame.

12. The audio decoder apparatus of claim 7, wherein the controller is adapted for analyzing a high-pass filtered version of the previous frame.

13. A method for decoding encoded frames to acquire frames of a sampled audio signal, wherein a frame comprises a number of time domain audio samples, comprising:

decoding, performed by a redundancy retrieving decoder, the encoded frames to acquire information on a prediction domain frame, and information on coefficients for a synthesis filter and/or a frame spectrum;

determining, performed by a predictive synthesis stage, a predicted frame of audio samples based on the information of the coefficients for the synthesis filter and the information on the prediction domain frame;

transforming, performed by a time domain transformer, the frame spectrum to the time domain to acquire a transformed frame from the frame spectrum;

combining, performed by a combiner, the transformed frame and the predicted frame to acquire the frames of the sampled audio signal; and controlling, performed by a controller, a switch-over process, the switch-over process being effected when a previous frame is based on the transformed frame, and a current frame is based on thr predicted frame;

providing, performed by the controller, a switching coefficient for initialization by estimating an LPC filter corresponding to an end of the previous frame so that a predictive synthesis stage is initialized when the switch-over process is effected, wherein at least one of the redundancy retrieving decoder, the predictive synthesis stage, the time domain transformer, the combiner and the controller comprises a hardware implementation.

14. A non-transitory computer-readable storage medium having stored thereon a computer program comprising a program code for performing, when a computer program runs on a computer or processor, the method for encoding frames of a sampled audio signal to acquire encoded frames, wherein a frame comprises a number of time domain audio samples, comprising:

determining information on coefficients of a synthesis filter and information on a prediction domain frame based on a frame of audio samples;

transforming a frame of audio samples to the frequency domain to acquire a frame spectrum;

deciding whether encoded data for a frame is based on the information on the coefficients and on the information on the prediction domain frame, or based on the frame spectrum;

determining information on a switching coefficient when it is decided that encoded data of a current frame is based on the information on the coefficients and the information on the prediction domain frame when encoded data of a previous frame was encoded based on a previous frame spectrum acquired by the frequency domain transformer; and encoding the information on the prediction domain frame, the information on the coefficients, the information on the switching coefficient and/or the frame spectra, wherein the information on the switching coefficient comprises an information enabling an initialization of a predictive synthesis stage, and the determination of the information on the switching coefficient is performed based on an LPC analysis of the previous frame, and the controller is adapted for determining the information on the switching coefficient based on a high pass filtered version of a decoded frame spectrum of the previous frame.

15. A non-transitory computer-readable storage medium having stored thereon a computer program comprising a program code for performing, when a computer program runs on a computer or processor, the method for decoding encoded frames to acquire frames of a sampled audio signal, wherein a frame comprises a number of time domain audio samples, comprising:

decoding the encoded frames to acquire information on a prediction domain frame, and information on coefficients for a synthesis filter and/or a frame spectrum;

determining a predicted frame of audio samples based on the information of the coefficients for the synthesis filter and the information on the prediction domain frame;

transforming the frame spectrum to the time domain to acquire a transformed frame from the frame spectrum;

combining the transformed frame and the predicted frame to acquire the frames of the sampled audio signal; and controlling a switch-over process, the switch-over process being effected when a previous frame is based on the transformed frame, and a current frame is based on thr predicted frame;

providing a switching coefficient for initialization by estimating an LPC filter corresponding to an end of the previous frame so that a predictive synthesis stage is initialized when the switch-over process is effected.

* * * * *

UNITED STATES PATENT AND TRADEMARK OFFICE

CERTIFICATE OF CORRECTION

PATENT NO. : 8,751,246 B2
APPLICATION NO. : 13/004335
DATED : June 10, 2014
INVENTOR(S) : Jeremie Lecomte et al.

It is certified that error appears in the above-identified patent and that said Letters Patent is hereby corrected as shown below:

On the Title Page, Item (73) Assignees:
"Fraunhofer-Gesellschaft zur Foerderung der Angewandten Forschung E.V.; Voiceage Corporation"
should be:
"Fraunhofer-Gesellschaft zur Foerderung der angewandten Forschung e.V.; VoiceAge Corporation"

In the Claims

Column 16, Claim 4, lines 62-63:
"...the switching coefficient represent..."
should be:
"...the switching coefficient represents..."

Column 18, Claim 13, line 54:
"...is based on thr predicted frame;"
should be:
"...is based on the predicted frame;"

Column 20, Claim 15, line 23-24:
"...is based on thr predicted frame;"
should be:
"...is based on the predicted frame;"

Signed and Sealed this
Twenty-third Day of June, 2015

Michelle K. Lee

Michelle K. Lee
*Director of the United States Patent and Trademark Office*